US006591887B1

(12) United States Patent
Hsu

(10) Patent No.: US 6,591,887 B1
(45) Date of Patent: Jul. 15, 2003

(54) VARIABLE DRAPERY BLIND STRUCTURE

(75) Inventor: Pey-Son Hsu, Changhua Hsien (TW)

(73) Assignee: Ching Feng Blinds Ind. Co., Ltd. (TW)

( * ) Notice: Subject to any disclaimer, the term of this patent is extended or adjusted under 35 U.S.C. 154(b) by 0 days.

(21) Appl. No.: 10/145,708

(22) Filed: May 16, 2002

(51) Int. Cl.[7] ..... E06B 3/48
(52) U.S. Cl. ..... 160/84.03
(58) Field of Search ..... 160/84.01, 84.03, 160/84.04, 84.06, 84.07, 115

(56) References Cited

U.S. PATENT DOCUMENTS 4,953,610 A * 9/1990 Phillips et al. ..... 160/84.03
5,197,526 A * 3/1993 Schon ..... 160/115 X
5,341,864 A * 8/1994 Rupel et al. ..... 160/84.03
5,662,147 A * 9/1997 Haiber ..... 160/84.01
5,787,951 A * 8/1998 Tonomura et al. ..... 160/84.03
6,431,245 B1 * 8/2002 Shen ..... 160/84.03

* cited by examiner

*Primary Examiner*—David Purol
(74) *Attorney, Agent, or Firm*—Bacon & Thomas, PLLC

(57) ABSTRACT

A variable Roman drapery blind structure. The structure includes an upper beam, a transparent drapery blind piece, drapery blind pieces, and counterweight rods. The underside of the upper beam is fixedly fastened to the top edges of both the transparent drapery blind piece and one of the drapery blind pieces. A pull cord unit is disposed at an inner side of the upper beam to either collect or unfold said transparent drapery blind piece along with the drapery blind pieces. A variation pull cord having pieces of controlling pull cords attached thereto at one end is disposed at the other inner side of the upper beam to adjust the drapery blind pieces for variations. Except the first one, the drapery blind pieces are secured to one side of a multiple of long hollow tubes disposed on the transparent drapery blind piece. In addition, the counterweight rods can be adapted in different numbers and locations to vary the curvature and angle of the drapery blind pieces for various displays of the blind structure.

8 Claims, 5 Drawing Sheets

VARIABLE DRAPERY BLIND STRUCTURE

BACKGROUND OF THE INVENTION

The present invention is related to a variable Roman drapery blind structure, comprising an upper beam whose underside is fixedly fastened to the top edges of both a transparent drapery blind piece and one of a plurality of drapery blind pieces. A pull cord unit is disposed at one inner side of said upper beam to either collect or unfold said transparent drapery blind piece along with said drapery blind pieces up or down. A variation pull cord having pieces of controlling pull cords attached thereto is disposed at the other inner side of said upper beam to adjust said drapery blind pieces for variations. In addition, a multiple of counterweight rods can be adapted to vary the curvature and angle of said drapery blind pieces for more various display of said blind structure thereof.

Please refer to FIG. 1. A conventional Roman drapery blind structure 10 is made up of a drapery body 11 of proper length and width, whose top edge is fixedly attached to the underside of an upper beam 12. The drapery body 11 is unfolded downwards, and then folded back and seamed up with a seaming line 13 for each certain length, forming a plurality of equidistant long hollow holes 15 disposed from the top to the bottom edges thereof. A through rod 14 is led and located to each of said long hollow holes 15 thereof. A plurality of hanging ears 17 with through rings 16 attached thereto are properly and equidistantly fastened onto each said seaming line 13. A pull cord 18 disposed at one inner side of said upper beam 12 is led through each through ring 16 disposed at both lateral sides of said drapery body 11 and fastened to the last ones disposed at the lower section thereof. Said pull cord 18 can be drawn to lift up said fastened through rings 16, thus having said drapery body 11 collected upwards and folded up at each said long hollow hole 15 thereof respectively.

There are several drawbacks to such conventional Roman drapery blind structure 10. First, it is monotonous in use when the pull cord 18 is drawn and the drapery body 11 simply collected and hanging down with multi-layer folds. Second, it lacks any variations in the display of said drapery body 11 except serving only for the use of a sunshade. Third, it is one-dimensional in function without the possibility of adding any beauty or creativity to it.

SUMMARY OF THE PRESENT INVENTION

It is, therefore, the primary purpose of the present invention to provide a variable Roman drapery blind structure, especially a variable drapery blind structure having an upper beam whose underside is fixedly fastened to the top edges of both a transparent drapery blind piece and one of a multiple of drapery blind pieces wherein, except the upwards and downwards movements of said transparent drapery blind piece via a pull cord disposed at one inner side of said upper beam, said drapery blind pieces can be adjusted in curvature and angle for various display by means of a variation pull cord disposed at the other inner side of said upper beam.

It is, therefore, the secondary purpose of the present invention to provide a variable Roman drapery blind structure wherein said drapery blind pieces can be easily adjusted and varied to present different styles and outlooks, increasing beauty and creativity to said Roman drapery blind structure thereof.

It is, therefore, the third purpose of the present invention to provide a variable Roman drapery blind structure with or without a multiple of counterweight rods wherein, depending on the amount and location of said counterweight rods adapted, said drapery blind pieces can be easily and economically adjusted into various styles and patterns for more various display of said Roman drapery blind structure thereof

DETAILED DESCRIPTION OF THE PREFERRED EMBODIMENTS

Figure 1:
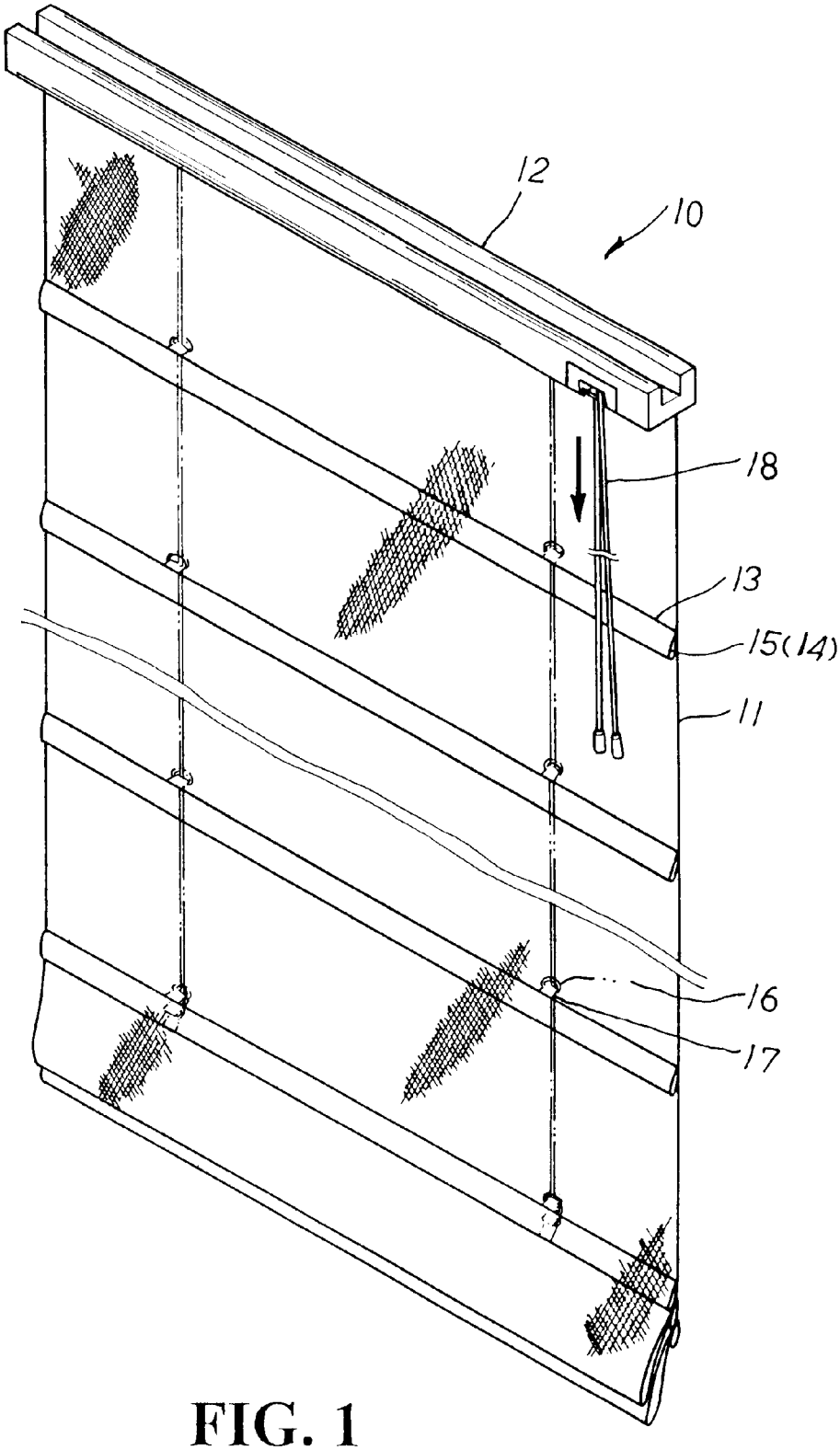
FIG. 1 PRIOR ART
FIG. 1 is diagram showing a conventional Roman drapery blind structure in a partly folded-up state.
Figure 2:
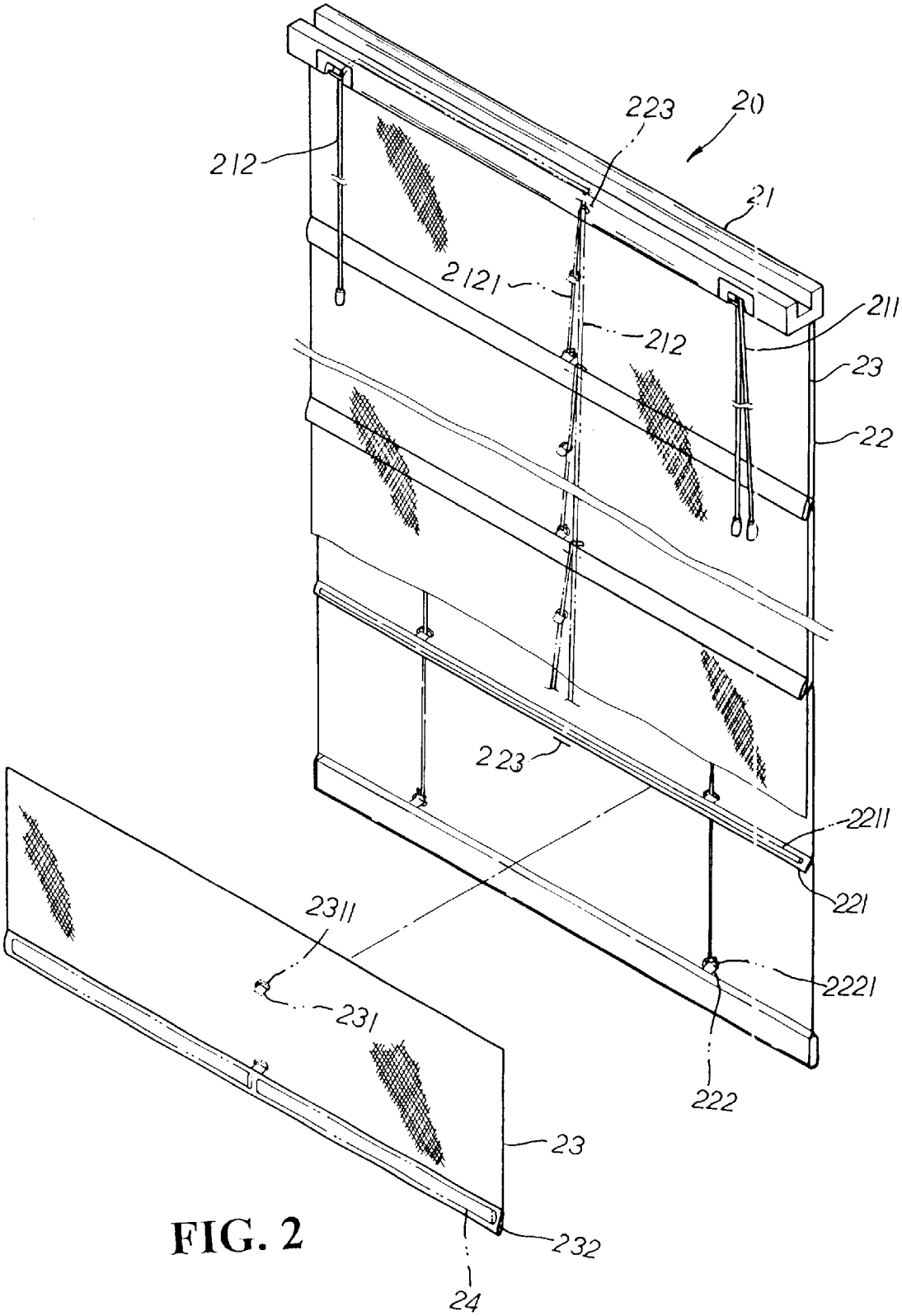
FIG. 2 is a perspective exploded view of the present invention.

Please refer to FIG. 2. The present invention is related to a variable Roman drapery blind structure 20, comprising an upper beam 21, a transparent drapery blind piece 22, a plurality of drapery blind pieces 23, and a plurality of counterweight rods 24. The underside of said upper beam 21 is fixedly fastened to the top edge of both said transparent drapery blind piece 22 and one of said drapery blind pieces 23. A pull cord unit 211 is disposed at one inner side of said upper beams 21, dividing into two branches to extend down from both lateral sides of said upper beam 21 at the back of said transparent drapery blind piece 22. A variation pull cord 212 is disposed at the other inner side of said upper beam 21, extending downwards from the back of said transparent drapery blind piece 22. A plurality of controlling pull cords 2121, each of proper length and fastened at one end to said variation pull cord 212, are equidistantly distributed from the upper to the lower sections of said variation pull cord 212. The transparent drapery blind piece 22, a drapery body of proper length and width, is equipped with a plurality of transverse long hollow tubes 221 at the front, each equidistantly located from others and having a transverse long rod 2211 led and located thereto. Both lateral sides at the back of said transparent drapery blind piece 22 are properly distributed with a plurality of first hanging ears 222, each, aligned equidistantly with others, having a first hanging ring 2221 attached thereto. A plurality of through holes 223 are also equidistantly distributed at the back of said transparent drapery blind piece 22 from the upper to the lower sides thereof. Said drapery blind pieces 23 make up a drapery body of the same length and width as said transparent drapery blind piece 22. Except the one attached to the underside of said upper beam 21, each of the other drapery blind pieces 23 is fixedly fastened to one side of each said transverse long hollow tube 221 thereof respectively A plurality of second hanging ears 231, each having a second hanging ring 2311 attached thereto, are disposed at the back of each drapery blind piece 23. One side of said drapery blind piece 23 is provided with a transverse sleeve tube 232 to which a plurality of counterweight rods 24 can be adapted and located for variable drapery displays.

In assembly, the two branches of said pull cord unit 211 are respectively led through said first hanging rings 2221 thereof in a sequential manner from the top downwards and then fastened at one end to the final first hanging ring 2221 disposed at the bottom of said transparent drapery blind piece 22. Each of said controlling pull cord 2121, fastened to said variation pull cord 212 at one end and led from the back to the front sides of said transparent drapery blind piece 22 via said through holes 223, is led through said second hanging rings 2311 thereof and fastened at the other end to the final second hanging ring 2311 disposed at the bottom of said drapery blind piece 23. Said counterweight rods 24 can be adapted and located therein said transverse sleeve tubes 232 thereof to complete the assembly of the present invention.

Figure 3:
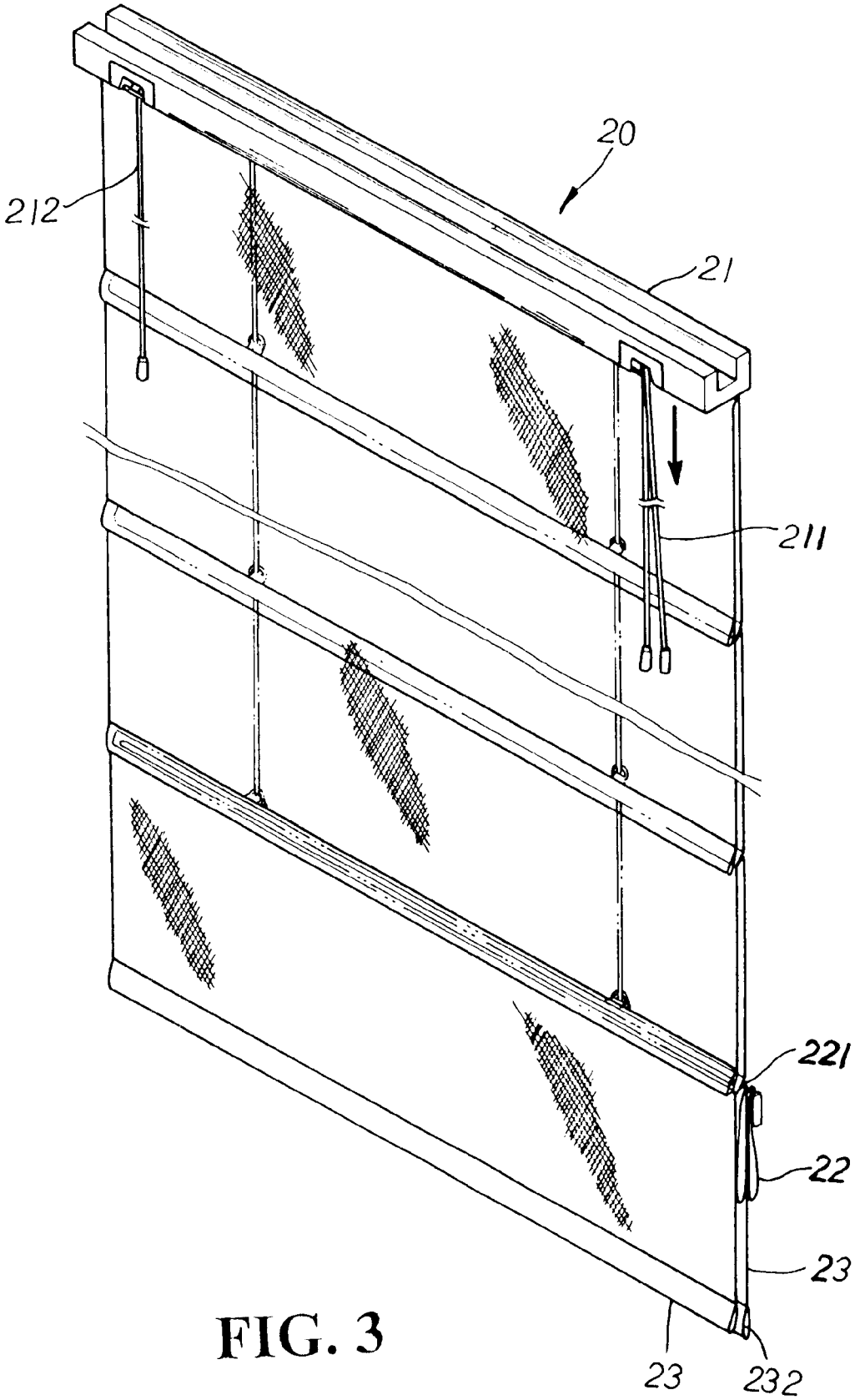
FIG. 3 is a diagram showing the present invention in a partly folded-up state.

Please refer to FIG. 3. To collect said variable Roman drapery blind 20, said pull cord unit 211 disposed at one inner side of said upper beam 21 is drawn, lifting upwards the fastened first hanging rings 2221 disposed at the bottom of said transparent drapery blind piece 22 thereof. Said up-lifting hanging rings 2221 thereof will consequentially and consecutively bring up said transparent drapery blind piece 22 along with said drapery blind pieces 23 attached thereto, having said transparent drapery blind piece 22 folded up in multi-layers and each drapery blind piece 23 hanging down at each said transverse long hollow tube 221 thereof For variations in style and pattern of said Roman drapery blind 20 thereof, counterweight rods 24 can be adapted and located therein said transverse sleeve tubes 232 thereof to vary the curvature and angle of said drapery blind pieces 23. According to the amount and location of said counterweight rods 24 adapted, said drapery blind pieces 23 is capable of presenting a variety of drapery blind displays with different angles and styles. Moreover, said second hanging ears 231 with second hanging rings 2311 attached thereto are distributed in corresponding location to that of said counterweight rods 24.

Figure 4:
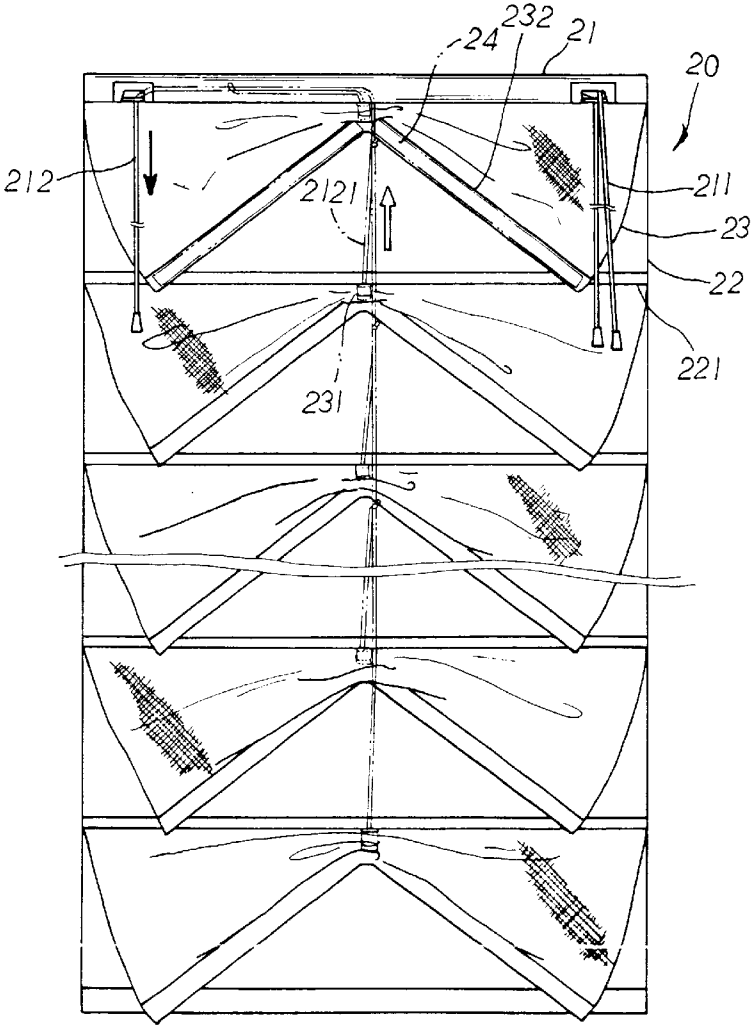
FIG. 4 is a diagram showing a variation of the present invention.

Please refer to FIG. 4. In case that two counterweight rods 24 are adapted and located within each said transverse sleeve tube 232 thereof, said variation pull cord 212 is extended downwards from the middle of said upper beam 21 at the back of said transparent drapery blind piece 22. A plurality of second hanging ears 231 with second hanging rings 2311 attached thereto are disposed at the middle section of each said drapery blind piece 23. Each of said controlling pull cord 2121 attached at one end to said variation pull cord 212 is led through each of said second hanging ring 2311 to be tied up at the other end onto the final second hanging ring 2311 disposed at the bottom of each drapery blind piece 23. When said variation pull cord 212 is drawn to move upwards each said controlling pull cord 2121 respectively, the pulling force of each controlling pull cord 2121 will lift up the fastened second hanging ring 2311 thereof, thus bringing up each said drapery blind piece 23 from the middle section thereof, and forming an inverted V-shaped edge displayed at the bottom of each said drapery blind piece 23 as shown in FIG. 4.

Figure 5:
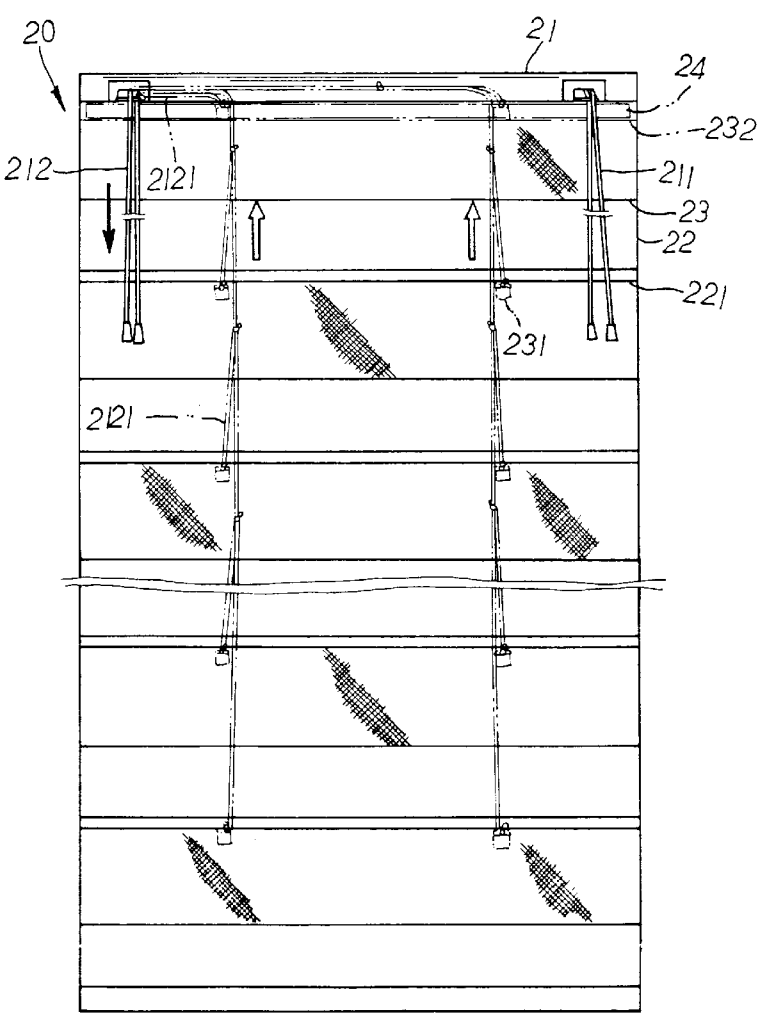
FIG. 5 is a diagram showing a second variation of the present invention.

Please refer to FIG. 5. In case that one counterweight rod 24 is adapted and located within each transverse sleeve tube 232 thereof, said variation pull cord 212 is bifurcated into two branches at both lateral sides of said upper beam 21 and extended downwards at the back of said transparent drapery blind piece 22. A plurality of said second hanging ears 231 with second hanging rings 2311 attached thereto are distributed at both lateral sides of each said drapery blind piece 23 from the upper to the lower sections thereof. Each of said controlling pull cord 2121 is led through said second hanging rings 2311 to be tied up at one end onto the last one thereof. When said variation pull cord 212 is drawn, said controlling pull cords 2121 will lift up said fastened hanging rings 2311 thereof, having each said drapery blind piece 23 gathered up from both lateral sides thereof and folded up inwards at each said transverse long hollow tube 221 thereof, and revealing sections of said transparent drapery blind piece 22 therebetween every two folded-up drapery blind pieces 23 as shown in FIG. 5.

Figure 6:
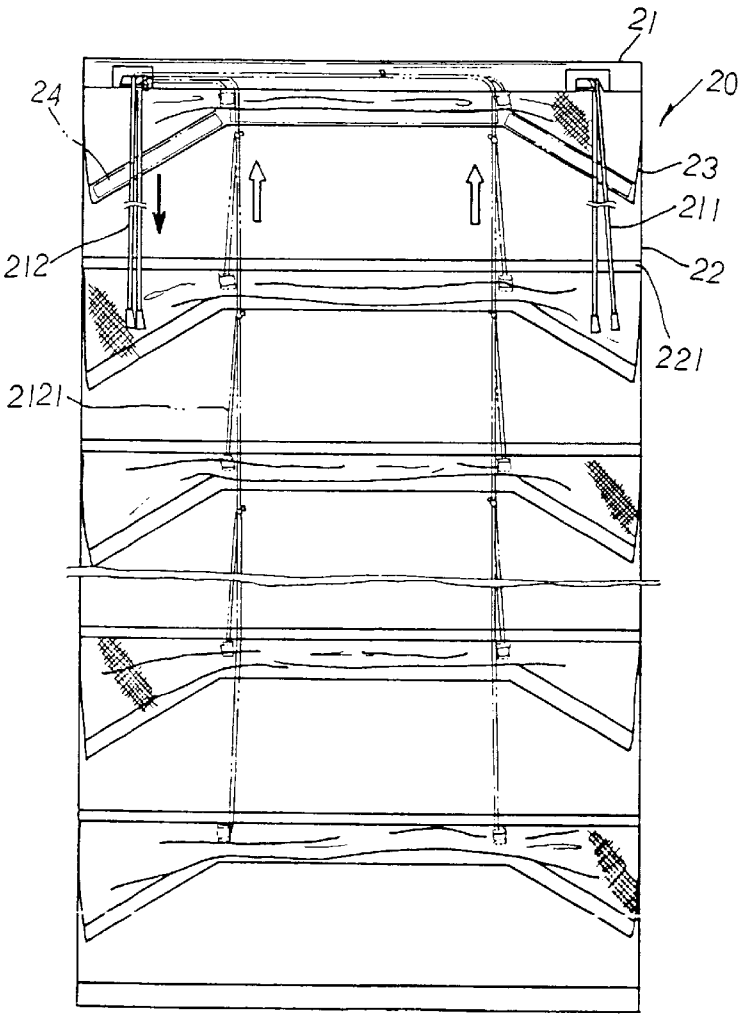
FIG. 6 is a diagram showing a third variation of the present invention.

Please refer to FIG. 6. In case that three counterweight rods 24 are adapted and located within each said transverse sleeve tube 232 thereof, said variation pull cord 212 is properly bifurcated into two branches at both lateral sides of said upper beam 21 and extended downwards at the back of said transparent drapery blind piece 22. A plurality of second hanging ears 231 with second hanging rings 2311 attached thereto are distributed at both lateral sides of said drapery blind piece 23, properly matching to the location of said counterweight rods 24. Each of said controlling pull cord 2121 is successively led through said second hanging rings 2311 thereof with one end thereof tying onto the last one thereof. When said variation pull cord 212 is drawn, said controlling pull cords 2121 will lift upwards said fastened second hanging rings 2311 thereof, thus bringing and gathering up the middle section of each said drapery blind piece close to each said transverse long hollow tube 221 thereof with both lateral sides thereof hanging down with a slanting angle as shown in FIG. 6.

Figure 7:
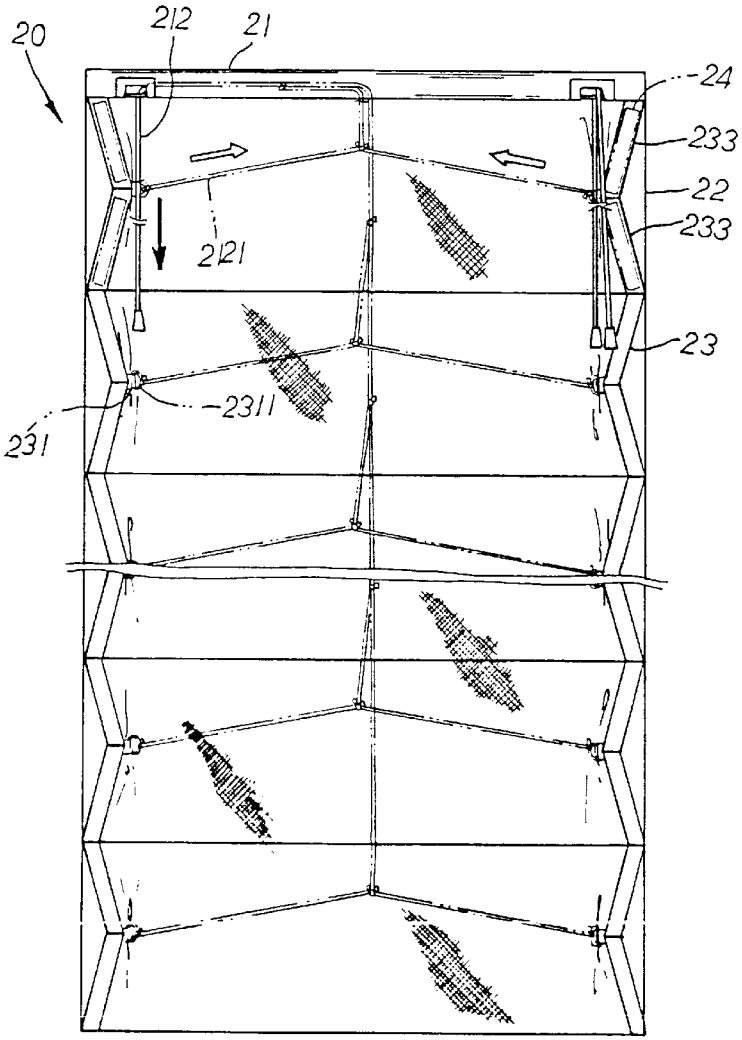
FIG. 7 is a diagram showing a fourth variation of the present invention.

Please refer to FIG. 7. Two counterweight rods 24 can also be adapted and located at both lateral edges of each said drapery blind piece 23. Each of said lateral edge thereof is provided with an upper and lower vertical sleeve tubes 233 for said two counterweight rods 24 to be led and located thereto respectively. A second hanging ear 231 with a second hanging ring 2311 attached thereto is disposed respectively at both the middle section of said drapery blind piece 23 and the joint between said upper and lower vertical sleeve tubes 233 thereof. Each of said controlling pull cord 2121 is bifurcated into two branches, each tying up at one end onto said hanging ring 2311 disposed at one lateral edge thereof. When said variation pull cord 212 is drawn, said controlling pull cords 2121 will be pulled upwards at the same time, thus moving inwards said fastened hanging rings 2311 and bringing in each said drapery blind piece 23 from both lateral sides thereof to form indented V-shaped edges at both lateral sides thereof as shown in FIG. 7.

What is claimed is:

1. A variable Roman drapery blind structure, comprising:

an upper beam, a transparent drapery blind piece, a drapery body comprising plurality of drapery blind pieces wherein an underside of said upper beam is fixedly fastened to top edges of both said transparent drapery blind piece and one of said drapery blind pieces;

said drapery body includes a plurality of equidistant transverse long hollow tubes each having a through rod therein disposed at a front side of the drapery body, a plurality of first hanging ears, each having a first hanging ring attached thereto, disposed along vertical length of the drapery body, and a plurality of through holes distributed equidistantly along the vertical length of the drapery body;

a pull cord unit disposed at an inner side of said upper beam and extending downwards at the back of said transparent drapery blind piece, the pull cord unit extends through each of said first hanging rings disposed at lateral sides thereof;

said drapery body comprising said drapery blind pieces are substantially of the same length and width as said transparent drapery blind pieces, said drapery blind pieces are attached to one side of each said transverse long hollow tubes, the drapery pieces include a plurality of second hanging ears having second hanging rings attached thereto and disposed at a back thereof;

a variation pull cord disposed at an other inner side of said upper beam and extending downwards from the back of said transparent drapery blind piece, said variation pull cord has a plurality of controlling pull cords having length equidistantly distributed and fixedly attached thereto;

whereby, said pull cord is used to control the upwards and downwards movements of said transparent drapery blind piece along with said drapery blind pieces attached thereto, and said variation pull cord is configured to adjust said drapery blind pieces for various displays of said drapery blind structure; and counterweight rods are secured to said drapery blind pieces to vary the shape of the drapery body when the pull cord unit is activated.

2. The variable Roman drapery blind structure as claimed in claim 1, wherein each of said drapery blind pieces is provided with a long sleeve tube disposed at one side thereof.

3. The variable Roman drapery blind structure as claimed in claim 1, wherein said counterweight rods are adapted and located in said long sleeve tubes thereof.

4. The variable Roman drapery blind structure as claimed in claim 1, wherein said second hanging ears, each having a second hanging ring attached thereto, disposed at the back of said drapery blind pieces are correspondingly matched to the location of said counterweight rods.

5. The variable Roman drapery blind structure as claimed in claim 1, wherein when two of said counterweight rods are secured in said transverse sleeve tube, said variation pull cord, extending downwards from the middle section of said upper beam at the back of said transparent drapery blind piece, is drawn to move upwards each of said controlling pull cords, each attached to said variation pull cord at one end and passed through the through hole of said transparent drapery blind piece at the other end, is extended through said second hanging rings disposed at the middle section of each drapery blind piece and fastened onto the last one thereof, lifting up said fastened hanging ring and bringing up said drapery blind piece from the middle section to form an inverted V-shaped edge displayed at the bottom thereof.

6. The variable Roman drapery blind structure as claimed as claim 1, wherein when only one of said counterweight rods is configured in said transverse sleeve tube thereof, said variation pull cord, extending downwards from both lateral sides of said upper beam at the back of said transparent drapery blind piece, is drawn to move upwards each of said controlling pull cords which, successively leads through each of said second hanging rings disposed at both lateral sides at the back of each drapery blind piece and fastened onto the last ones thereof, will lift up said fastened second hanging rings, having each said drapery blind piece folded up inwards at said transverse long hollow tube thereof and revealing sections of said transparent drapery blind piece disposed therebetween every two folded-up drapery blind pieces.

7. The variable Roman drapery blind structure as claimed in claim 1, wherein when three of said counterweight rods are configured in each of said transverse sleeve tubes, said variation pull cord, extending downwards from lateral sides of said upper beam at the back of said transparent drapery blind piece, is drawn to move upwards each of said controlling pull cords which, successively leads through each said second hanging rings said fastened second hanging rings will be upwardly lifted, bringing up the middle section of each said drapery blind piece to gather and fold up close to each of said transverse long hollow tubes with both lateral sides of said drapery blind piece thereof hanging down in a slanting angle for display.

8. The variable Roman drapery blind structure as claimed in claim 1, wherein when two of said counterweight rods are configured to an upper and lower vertical sleeve tubes disposed at each lateral edge of said drapery blind piece; a second hanging ear having a second hanging ring attached thereto is respectively disposed at both the middle section of said drapery blind piece and the joint between said upper and lower vertical sleeve tube thereof; said variation pull cord is drawn to move upwards each of said controlling pull cords which, bifurcating into two branches to be tied up at both ends onto second hanging rings disposed at both lateral edges thereof, will pull inwards said fastened hanging rings and bringing in each said drapery blind piece from both lateral sides thereof to form indented V-shape edges at both lateral sides for variation.

* * * * *